United States Patent [19]

Watanabe et al.

[11] Patent Number: 4,840,152

[45] Date of Patent: Jun. 20, 1989

[54] V-TYPE VERTICAL ENGINE

[75] Inventors: Yoshimi Watanabe; Shinichi Miyakoshi; Kenichi Goto, all of Wako, Japan

[73] Assignee: Honda Giken Gokyo Kabushiki Kaisha, Tokyo, Japan

[21] Appl. No.: 49,305

[22] Filed: May 13, 1987

[30] Foreign Application Priority Data

May 16, 1986 [JP] Japan ..... 61-112123
May 16, 1986 [JP] Japan ..... 61-073655[U]
May 16, 1986 [JP] Japan ..... 61-073656[U]

[51] Int. Cl.[4] ..... F02B 75/22

[52] U.S. Cl. ..... 123/52 MV; 123/41.82 R; 123/41.08; 123/41.74; 123/41.86

[58] Field of Search ..... 60/320, 321; 123/41.74, 123/41.08, 41.82 R, 41.86, 574, 52 MV, 572

[56] References Cited

U.S. PATENT DOCUMENTS 1,836,189 12/1931 Salisbury ..... 123/41.74
2,722,203 11/1955 Drinkard et al. ..... 123/52 MV
3,455,285 7/1969 Sheppard ..... 123/574
3,884,201 5/1975 Cregan ..... 123/52 MV
4,082,068 4/1978 Hale ..... 123/41.82 R

*Primary Examiner*—Willis R. Wolfe
*Assistant Examiner*—M. Macy
*Attorney, Agent, or Firm*—Nixon & Vanderhye

[57] ABSTRACT

Disclosed is a V-type vertical engine which is particularly advantageous for use as an outboard marine engine. This engine typically comprises a crank shaft extending vertically; a pair of cylinder banks; intake ports which are located adjacent to the internal sides of the cylinder banks; intake tubes which are connected to the intake ports and, at least in part thereof, extend along a central line between the two cylinder banks away from a crank shaft of the engine; a carburetor unit including at least one carburetor having a pair of intake passages which communicate with the intake ports belonging to different ones of the cylinder banks and a single float chamber which is common to both the intake passages; exhaust ports which are located adjacent to the external sides of the cylinder banks; and exhaust passages which, at least in part thereof, extend along a cylinder axial line towards the crank case. The cooling water for the engine is introduced into the water jackets of the cylinder block and the cylinder heads from the bottom end of the engine and expelled from the top ends of the cylinder banks by way of a pair of tubes which are joined into a thermostat valve chamber. The thermostat chamber is further connected to a central conduit which extends vertically between the two cylinder banks and conducts the cooling water from the thermostat chamber to the surrounding water.

7 Claims, 6 Drawing Sheets

V-TYPE VERTICAL ENGINE

TECHNICAL FIELD

The present invention generally relates to a V-type vertical engine which is vertical in the sense that its crank shaft extends vertically and which is suitable for use as an outboard marine engine and in particular to a V-type outboard marine engine having an improved layout structure.

BACKGROUND OF THE INVENTION

It is advantageous in an outboard marine engine system to arrange the crank shaft of the engine to extend vertically because the output shaft of the engine typically extends vertically between the engine which is at the top of the engine system and the propeller which is at the bottom of the engine system and submerged underwater. As the number of cylinders of the engine is increased to the end of increasing the engine output, it becomes desirable to design the engine as a V-type engine and reduce the overall length of the crank shaft.

In a vertical engine having a vertical crank shaft, distributing air-fuel mixture to each cylinder is very important because of the gravity acting upon the air/fuel mixture could cause uneven distribution of the mixture between the upper cylinders and the lower cylinders. Therefore, it is advantageous to provide a separate carburetor to each of the cylinders.

When a V-type engine is applied as an outboard marine engine, the lateral width of the engine is desired to be reduced as much as possible. Therefore, if a separate carburetor is to be provided to each of the cylinders, accommodating the engine intake system in a limited space imposes a serious difficulty on engine design.

In order to reduce the overall width of the vertical engine, it is desirable to bring the exhaust manifold as close to the engine as possible. However if the exhaust manifold is brought close to the engine, the heat from the exhaust manifold could cause an undesirable heat distribution around the cylinders.

Another important factor to be considered in designing a V-type vertical engine is the layout of cooling water passages. In an outboard marine engine, cooling water is typically collected from the surrounding water by way of a water inlet provided in a lower part of the engine system and submerged underwater. The collected water is then circulated in the water jacket defined in the engine and cools various parts of the engine before it is expelled back to the surrounding water. Because warm water is smaller in density than cool water, it is advantageous to arrange cooling water passages in such a manner that the collected water is supplied into the water jacket from a lower part of the engine and the water warmed by the engine heat is expelled from an upper part of the engine.

Therefore, a cooling water passage is necessary for conducting the cooling water expelled from the upper part of the engine into the surrounding water. The necessity for this cooling water passage is an additional factor to be considered in designing a V-type vertical engine. If this passage is provided in the cylinder block, the structure of the cylinder block will be made excessively complicated and the accessibility of the cooling water passage system will be severely restricted.

However, arranging a conduit for this cooling water passage externally to the cylinder block or the cylinder head will cause the problem of interference with other accessory devices of the engine. Furthermore, if the conduit is passed along a tortuous path, the flow resistance of the conduit may become excessive and the engine power will be wasted for pumping cooling water through the cooling water passages.

Yet another factor to be considered in designing a V-type vertical engine is the arrangement of a thermostat valve in the cooling system of the engine. To the end of maintaining the temperature of the cooling water at an appropriate level, circulation of the cooling water must be controlled by a thermo-valve or a thermostat valve. If this thermostat valve is installed in a cooling water passage formed within the cylinder head, the structure of the cylinder head tends to be complicated. Also, the thermostat is desired to be as accessible as possible for possible servicing purpose.

The crank case of the engine should be kept in a slightly negative pressure condition to assure the return of lubricating oil from the cylinder heads and preventing the generation of back pressure acting upon the pistons. Furthermore, because part of the combustion gas produced in the combustion chambers of the engine leak into the crank case, there is a need to ventilate the interior of the crank case. Typically, in a four-stroke engine, a breather passage having a one-way valve therein is provided for establishing a communication between the crank case and the atmosphere. To the end of preventing lubricating oil from being expelled from the engine along with the crank case gas, the opening end of the breather passage is required to have a certain volume to reduce the flow speed of the breather gas.

BRIEF SUMMARY OF THE INVENTION

In view of such problems of the prior art, a primary object of the present invention is to provide a V-type vertical engine which is suitable for use as an outboard marine engine.

Another object of the present invention is to provide a V-type vertical engine having a minimized lateral width.

Yet another object of the present invention is to provide a V-type vertical engine which is provided with a separate carburetor for each of the cylinders in an advantageous layout.

Yet another object of the present invention is to provide a V-type vertical engine having a carburetor which is both accessible and easy to mount.

Yet another object of the present invention is to provide a V-type vertical engine provided with an advantageous arrangement of cooling water passages.

Yet another object of the present invention is to provide a V-type vertical engine provided with cooling water passages with minimized flow resistance.

Yet another object of the present invention is to provide a V-type vertical engine having an advantageous layout for the thermostat valve of the cooling system of the engine.

According to the presdent invention, these and other objects of the present invention are accomplished by providing a V-type vertical engine having a crank shaft extending vertically and a pair of cylinder banks forming a certain angle therebetween, comprising: intake ports which are located adjacent to the internal sides of the cylinder banks and communicated with combustion chambers of the engine by way of intake valves; intake tubes which are connected to the intake ports and, at least in part thereof, extend along a central line between the two cylinder banks away from the crank shaft of the engine; and a carburetor unit including at least one carburetor having a pair of intake passages which communicate with the intake ports belonging to different ones of the cylinder banks and a single float chamber which is common to both the intake passages: or a V-type vertical engine having a crank shaft extending vertically and a pair of cylinder banks forming a certain angle therebetween, comprising: intake ports which are located adjacent to the internal sides of the cylinder banks and communicated with combustion chambers of the engine by way of intake valves; intake tubes which are connected to the intake ports and, at least in part thereof, extend along a central line between the two cylinder banks away from the crank shaft of the engine; exhaust ports which are located adjacent to the external sides of the cylinder banks and communciated with the combustion chambers of the engine by way of exhaust valves; and exhaust passages which, at least in part thereof, extend along a cylinder axial line towards the crank case.

According to a certian aspect of the present invention, the intake tubes are integrally formed with the cylinder heads of different cylinder banks and extend from the cylinder heads towards each other and away from the crank shaft of the engine, the free end surfaces of the intake tubes being located in a common vertical plane, and, preferably, the carburetor is mounted onto the free end surfaces of the intake tubes, the carburetor comprising a pair of intake passages communicating with different ones of the intake tubes and a pair of throttle valves having a common valve shaft and being provided in the respective intake passages of the carburetor.

According to another aspect of the present invention, the lateral external ends of exhaust passage members defining the exhaust passages are located more inwardly than the lateral external ends of the cylinder heads.

According to yet another aspect of the present invention, an exhaust manifold having a water jacket is integrally formed with the cylinder head.

According to yet another aspect of the present invention, a breather chamber communicating with the crank case is defined between the opposing faces of the cylinder banks and, preferably, the breather chamber is communicated with the crank case by way of a one way valve. This breather chamber can be defined either by a pair of opposing faces of the two cylinder banks, a bridging wall integrally formed with the cylinder block of the engine so as to connect the opposing faces of the cylinder banks with each other at their ends remote from the crank shaft, an end wall which is also integrally formed with the cylinder block and closes the bottom end of a space defined by the opposing faces and the bridging wall, and a plate member which is fitted over the open end of the space defined by the opposing faces, the bridging wall and the end wall, or, alternatively, by a pair of opposing faces of the two cylinder banks, a pair of end walls which are integrally formed with the cylinder block and close the top end and the bottom end of a space defined by the opposing faces, and a plate member which is fitted over the open end of the space defined by the opposing faces and the end walls.

According to yet another aspect of the present invention, there is provided a cooling water passage consisting of a central conduit extending in a central plane located between the two cylinder banks in parallel with the crank shaft of the engine.

According to yet another aspect of the present invention, a thermostat valve is accommodated in a thermostat valve chamber defined by a chamber member which is supported by a pair of transfer conduits extending from upper surfaces of the two cylinder banks, the thermostat valve chamber being communicated with water jackets in the cylinder banks by way of the transfer conduits as well as with the central conduit. Thus, use of only one thermostat valve is adequate for controlling the temperature of the cooling water of the engine and the structure of the cooling system for the engine is simplified.

DETAILED DECRIPTION OF THE PREFERRED EMBODIMENTS

Figure 1:
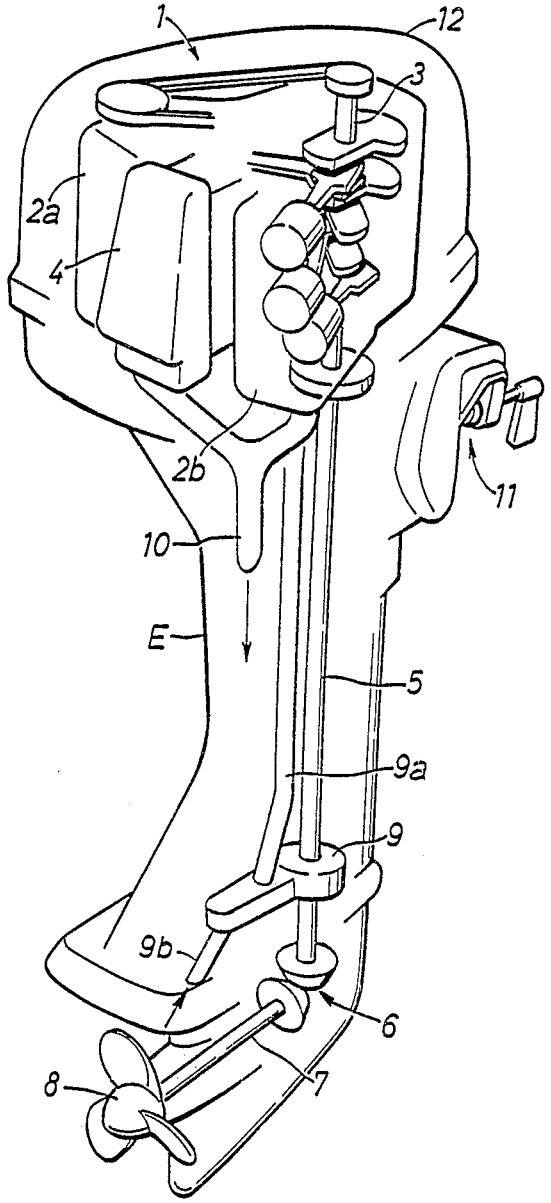
FIG. 1 is a see-through perspective view of an outboard marine engine according to the present invention.

FIG. 1 shows an overall view of an outboard marine engine system according to the present invention. The engine 1 comprises a pair of banks 2*a* and 2*b* of cylinders which are arranged in the shape of letter V and the crank shaft 3 of the engine is disposed vertically. A carburetor unit 4 is disposed between the two cylinder banks 2*a* and 2*b*.

The lower end of the crank shaft 3 is connected to a vertical output shaft 5 and the engine output taken out by this output shaft 5 is transmitted to a screw propeller 8 by way of a bevel gear device 6 and a propeller shaft 7 which extends horizontally from the bevel gear device 6 to the screw propeller 8.

A lower part of the output shaft 5 is provided with a water pump 9 for supplying cooling water collected from a submerged water inlet tube 9*b* to the engine 1 by way of a water supply tube 9*a*. The cooling water which has circulated within the engine 1 and cooled various parts of the engine 1 is conducted, by way of a water outlet tube which is incorporated with an exhaust tube 10 (as described in greater detail hereinafter), into a passage defined in an extension case E, which also serves as an expansion chamber for engine exhaust gas, to be ultimately expelled from the submerged portion of the engine system.

This outboard marine engine system is adapted to be fixed to the stern of a boat (not shown in the drawings) by means of a clamp device 11, and is generally covered by a detachable cowling 12.

Figure 2:
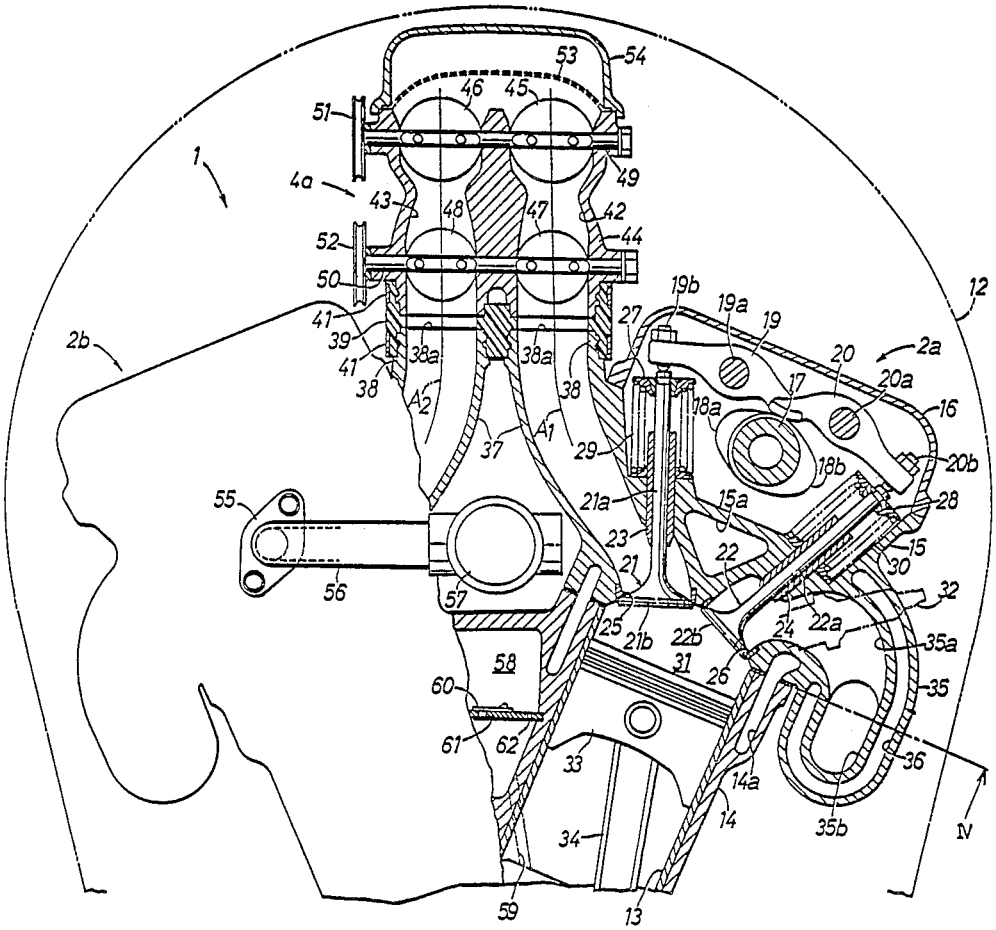
FIG. 2 is a partially broken away plan view of an embodiment of the engine according to the present invention.
Figure 3:
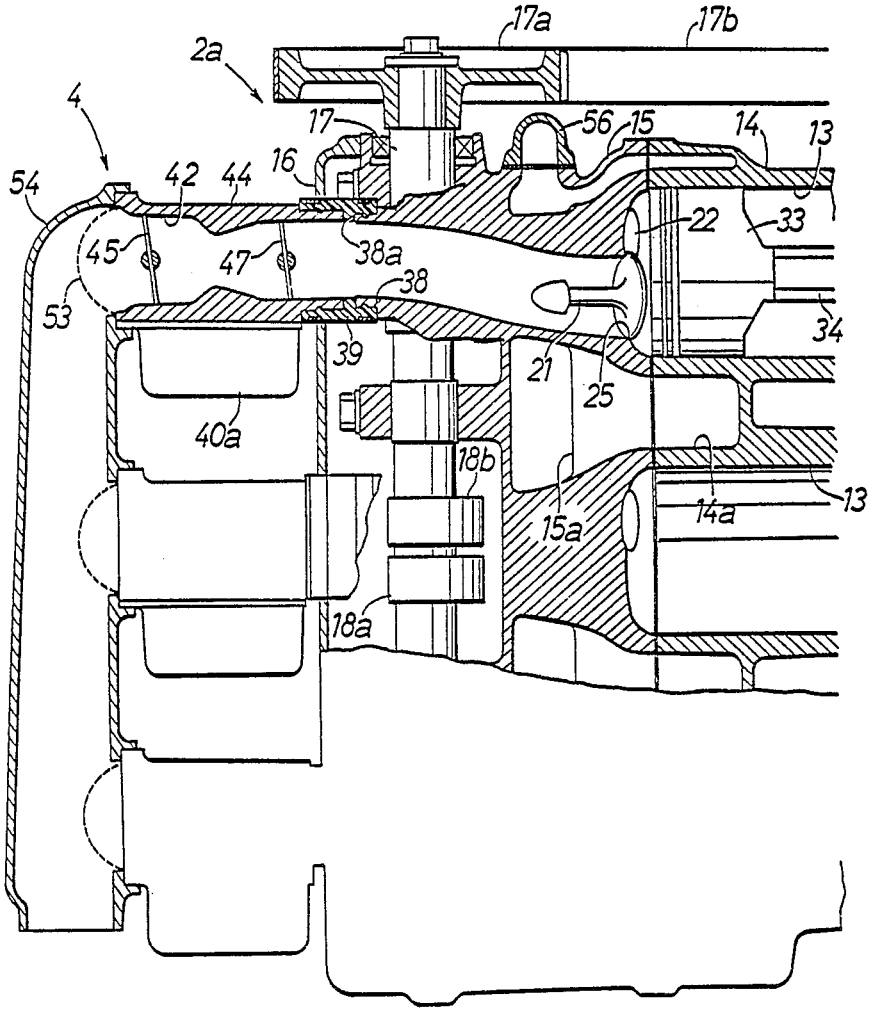
FIG. 3 is a partially broken away side view of the engine of FIG. 2.
Figure 4:
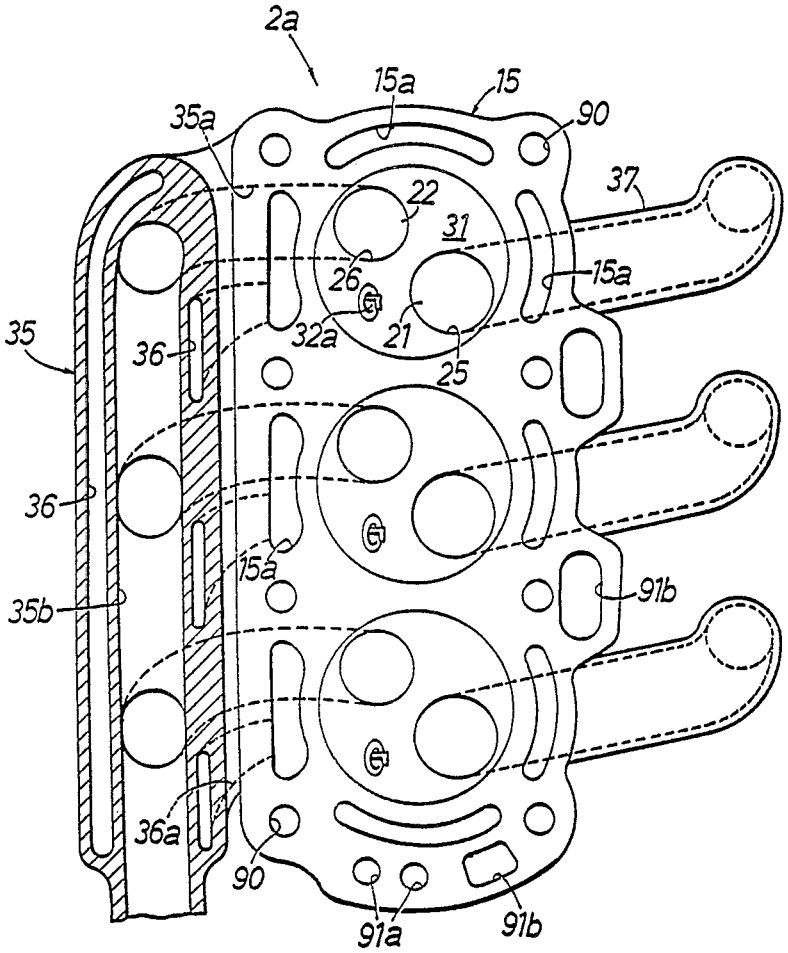
FIG. 4 is a sectional view taken along line IV of FIG. 2.

FIGS. 2 to 4 show various parts of the engine 1 in greater detail. The two cylinder banks 2*a* and 2*b* of this engine 1 each having three cylinders are similar to each other in structure and are arranged in the shape of letter V forming a 45 degree angle therebetween. In some of the following description only one of the two banks 2*a* and 2*b* is described for the convenience of description.

The cylinder banks 2*a* and 2*b* are formed in a cylinder block 14 defining three cylinders 13 on each cylinder bank along the longitudinal direction or in parallel with the crank shaft 3 which extends vertically and a pair of cylinder heads 15 are fixedly fitted over the free end surfaces of the cylinder banks 2*a* and 2*b* of the cylinder block 14 facing away from the crank shaft 3. The external end of each of the cylinder heads 15 is covered by a head cover 16.

Inside the chamber defined by the head cover 16 and the cylinder head 15, a cam shaft 17 is rotatably supported and is driven by the crank shaft 3 at half the rotational speed of the crank shaft 3 by way of a pulley 17*a* and a belt 17*b* passed around the pulley 17*a* (FIG. 3). Cams 18*a* and 18*b* provided on the cam shaft 17 are engaged to rocker arms 19 and 20. These rocker arms 19 and 20 are rotatably supported by rocker shafts 19*a* and 20*a* and the other ends of the rocker arms 19 and 20 are engaged to the stem ends of the intake valves 21 and exhaust valves 22 by way of adjustable tappet screws 19*b* and 20*b* provided on the other ends of the rocker arms 19 and 20.

The valve stems 21*a* and 22*a* of the intake valves 21 and the exhaust valves 22 are slidably fitted into valve guides 23 and 24 which are fixedly fitted into the cylinder head 15 while the valve portions 21*b* and 22*b* are adapted to selectively open and close intake ports 25 and exhaust ports 26 of the engine 1. Compression coil springs 29 and 30 are interposed between retainers 27 and 28 which are fixed around the stem ends of the valves 21 and 22 and the cylinder head 15 to bias the valves to their closed positions. In this example, each of the valves 21 and 22 is provided with a pair of compression coil springs of different spring constants arranged in a concentric manner for suppressing surging of the valves.

Thus, as the cam shaft 17 rotates in synchronization with the rotation of the crank shaft 3, the valves 21 and 22 are actuated and the intake of air/fuel mixture and exhaust of combustion gas into and from each combustion chamber 31 of the engine 1 are accomplished according to a predetermined schedule of a four-stroke engine. A plurality of spark plugs 32 are threaded into the cylinder head 15 at an oblique angle in such a manner that the electrode 32*a* (FIG. 4) of each of the spark plugs 32 protrudes into the combustion chamber 31 defined by the cylinder head 15 and the front surface of a piston 33 which is received in each of the cylinders in a slidable manner. The pistons 33 are connected to the crank shaft 3 by way of connecting rods 34 so as to convert the reciprocating motion of the pistons 33 owing to the combustion pressure of fuel into the rotary motion of the crank shaft 3.

An exhaust manifold 35 communciating with the exhaust ports 26 is provided on the external portion of each of the cylinder banks 2*a* and 2*b* integrally with the corresponding cylinder head 15. This exhaust manifold 35 collects the exhaust gas from the combustion chamber of each of the cylinders 13 and conduct it to the exhaust tube 10 which is shown in FIG. 1. The outer most part of the exhaust manifold 35 is provided with an water jacket 36 which is communicated with the water jackets 15*a* and 14*a* of the cylinder heads 15 and the cylinder block 14 for circulating the cooling water of the engine 1 therein. The exhaust manifold 35 is curved towards the cylinder block 14 at a passage 35*a* thereof and the elliptic cross section of the trunk passage 35*b* of the manifold 35 extending along the axial line of the crank shaft 3 is disposed in such a manner that the long axis of the cross section is aligned with the axial line of the cylinders. The side ends of the exhaust manifolds 35 are located more inside than the side ends of the head covers 16.

The internal side faces of the cylinder banks 2*a* and 2*b* are provided with intake tubes 37 which are formed integrally with the cylinder head 15 and communicate with the corresponding intake ports 25. The intake tubes 37 extend perpendicularly to the crank shaft 3 along a center line between the axial lines of the two cylinder banks 2*a* and 2*b*. The intake tubes 37 extending from the two cylinder banks 2*a* and 2*b* extend towards each other near their base ends and in parallel with each other near their free ends. Therefore, the axial lines A1 and A2 of the intake tubes 37 at the opening ends 38 are substantially parallel with each other. The free end surfaces 38*a* of the opening ends 38 of these intake tubes 37 are flush with each other or, in other words, are located in a common vertical plane.

The opening ends 38 of the intake tubes 37 are connected to a carburetor unit 4 by way of a joint member 39 which is made of rubber and serves also as a heat insulator between the carburetor unit 4 and the engine 1. The joint member 39 is fastened onto the abutting ends of the carburetor unit 4 and the intake tubes 37 by a pair of steel bands 41.

A pair of parallel intake passages 42 and 43 are defined in an integral main body 44 of each of the carburetors 4*a* of the carburetor unit 4 so as to communicate with the corresponding intake tubes 37, and choke valves 45 and 46 and throttle valves 47 and 48 are provided at upstream portions and downstream portions of the intake passage 42 and 43, respectively. The two choke valves 45 and 46 for the two intake tubes 37 for the mutually opposing cylinders 13 belonging to the different ones of the cylinder banks 2*a* and 2*b* have a common valve shaft 49 and the throttle valves 47 and 48 which are positioned in a similar relationship also have a common valve shaft 50. The external ends of the valve shafts 49 and 50 are provided with arms or pulleys 51 and 52 which are connected to the actuating devices for the throttle valves and the choke valves by way of wires not shown in the drawings.

The upstream ends of the intake passages 42 and 43 are covered by an air filter 53 which may consist of wire mesh and its external surface is protected by a cover 54 which is common to all the carburetors 4*a* and distributes intake air to each of the intake passages 42 and 43. Each of the carburetors 4*a* is thus provided with a pair of intake passages 42 and 43 which are communicated with a pair of cylinders of the different cylinder banks 2*a* and 2*b* opposing each other, and a single float chamber 40*a* which is common to the two intake passages 42 and 43.

In FIG. 4, numeral 90 denotes holes for passing through the bolts for securing the cylidner head 15 to the cylinder block 15 while numerals 91*a* and 91*b* denote holes for supplying and returning lubricating oil to and from the cylinder head 15. Numeral 32*a* denotes the electrode of the spark plug 32.

Figure 5:
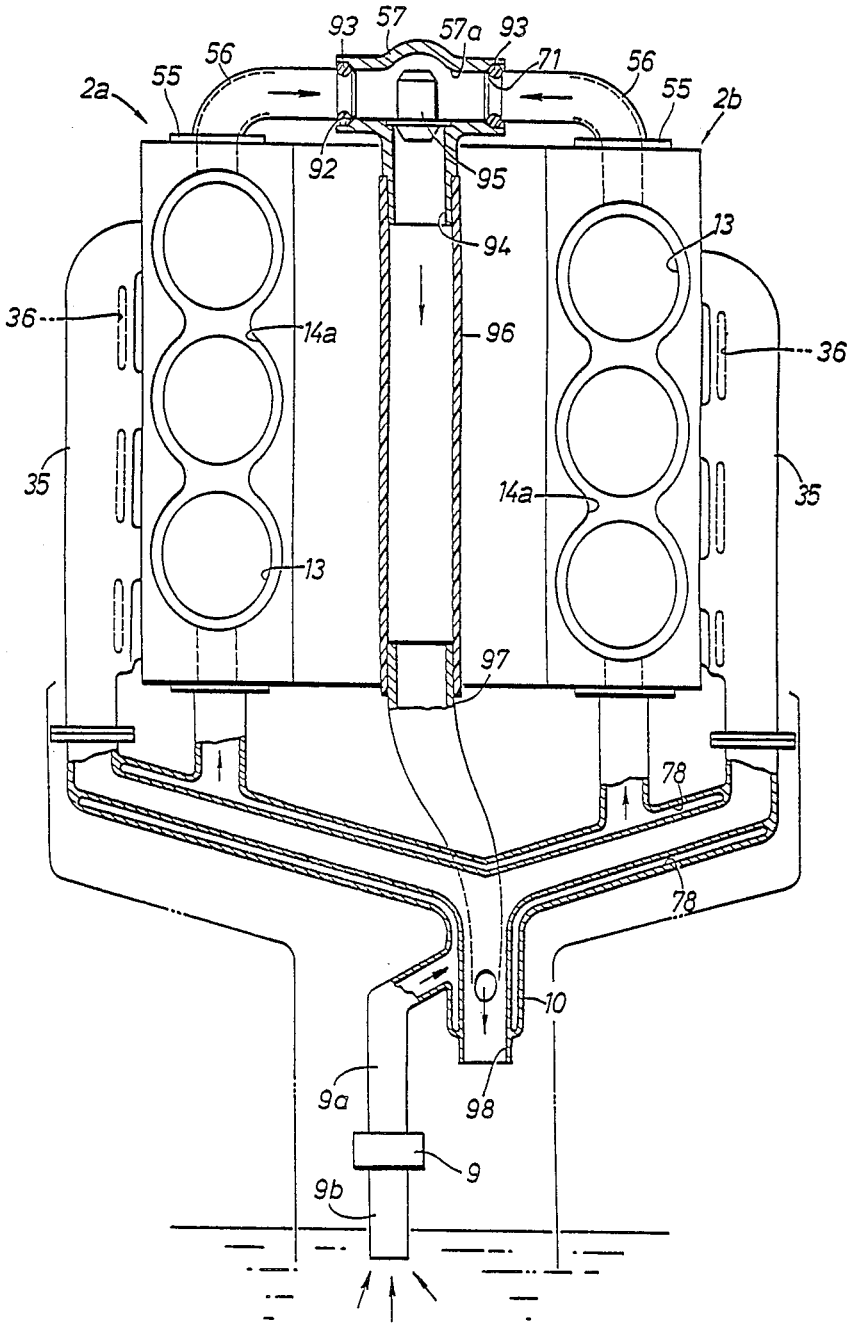
FIG. 5 is a schematic view showing the cooling system of the engine according to the present invention.

The arrangement of cooling water passages is described in the following mostly with reference to FIG. 5.

Water is collected by a water pump 9 having a submerged water inlet 9*b* from the surrounding water and is supplied into a water jacket 78 defined around the exhaust tube 10 by way of the water supply tube 9*a*. The water is then supplied into the water jackets 14*a* and 15*a* defined in the cylinder block 14 and the cylinder heads 15 from a lower axial end or, in other words, the bottom end of either the cylinder block 14 or the cylinder head 15 and also to water jackets 36 defined in the exhaust manifolds 35. The cooling water may be supplied to the water jacket 36 either directly from the water jacket 78 or by way of the water jacket 14*a* or 15*a* defined in the cylinder block 14 or the cylinder heads 15 as desired.

After cooling the cylinder block 14, the cylinder heads 15 and the exhaust manifolds 35, the cooling water is then conducted out from the water jacket 15*a* defined within each of the cylinder heads 15 by way of a conduit 56 which is connected to an axial end or, in other words, the top end of each of the cylinder banks 2*a* and 2*b* by means of a flange 55. This conduit 56 projects from the axial end surface of each of the cylinder banks 2*a* and 2*b* and is bent towards each other so as to be joined into a pair of inlets 92 of a thermostat chamber 57*a* defined in a thermostat chamber member 57 which is centrally located between the two cylinder banks 2*a* and 2*b*. Numeral 93 denotes O-rings which seal the connection between the inles 92 and the conduits 56 without causing undue stress in the conduits 56 when they are subjected to temperature changes.

The thermostat chamber member 57 is provided with another opening 94 which faces downwardly towards the space between the two cylinder banks 2*a* and 2*b* and a conduit 96 is connected to this opening 94. The communication between the inlets 92 and the opening 94 of the thermostat chamber 57*a* is controlled by a thermostat valve 95 which is accommodated within the thermostat chamber 57*a*. The conduit 96 extends vertically downwardly and is connected at its bottom end to a conduit 97 which opens into the outlet portion 98 of the exhaust tube 10.

The triangular space defined by the opposing surfaces of the two cylinder banks 2*a* and 2*b* is utilized for defining a breather chamber 58 which serves as a receiver tank for the crank case gas expelled from the crank case by the back pressure caused by the reciprocating motion of the pistons 33 and the leakage of combustion gas from the combustion chambers to the crank case. As shown in FIG. 2, the crank case gas is conducted from the crank case by way of a breather passage 59 which opens into the breather chamber 58 by way of a one-way valve 61 having a reed valve 60 so as to maintain the crank case under a slightly negative pressure condition. The lubricating oil contained in the crank case gas is separated from the gas in the breather chamber 58 and is returned to the crank case by way of small holes 62 provided in the one-way valve 61.

Figure 6:
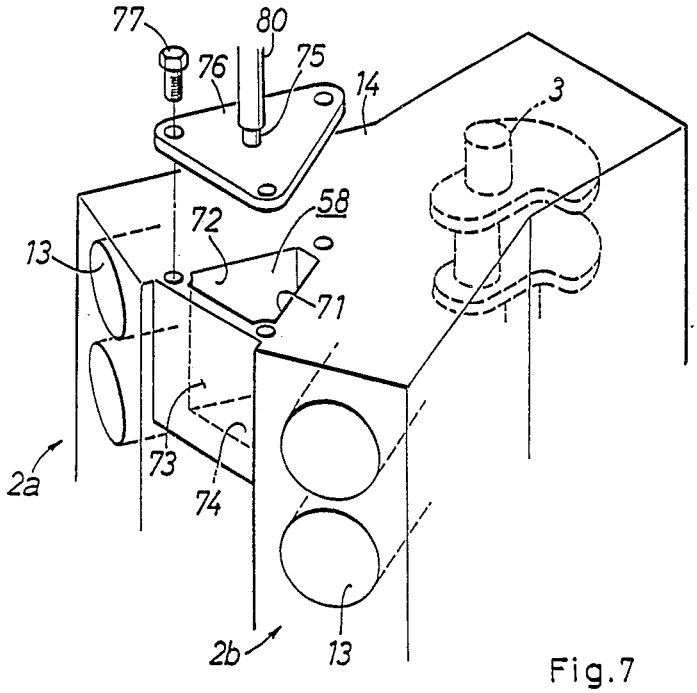
FIG. 6 is a schematic exploded perspective view of the breather chamber according to the present invention.

As shown in FIG. 6, the portion of the cylinder block 14 located between the opposing faces of the cylinder banks 2*a* and 2*b* is integrally provided with opposing surfaces 71 and 72 which define a V-shaped gap therebetween, a bridging wall 73 connecting the opposing surfaces 71 and 72 with each other at their ends remote from the crank shaft 3, an end wall 74 which closes the bottom end of a space defined by the opposing surfaces 71 and 72 and the bridging wall 73 and another end wall in the form of a plate 76 having a breather port 75 fitted over the top end of the space defined by the opposing surfaces 71 and 72 and the bridging wall 73 by means of bolts 77, thereby defining the enclosed breather chamber 58.

Figure 7:
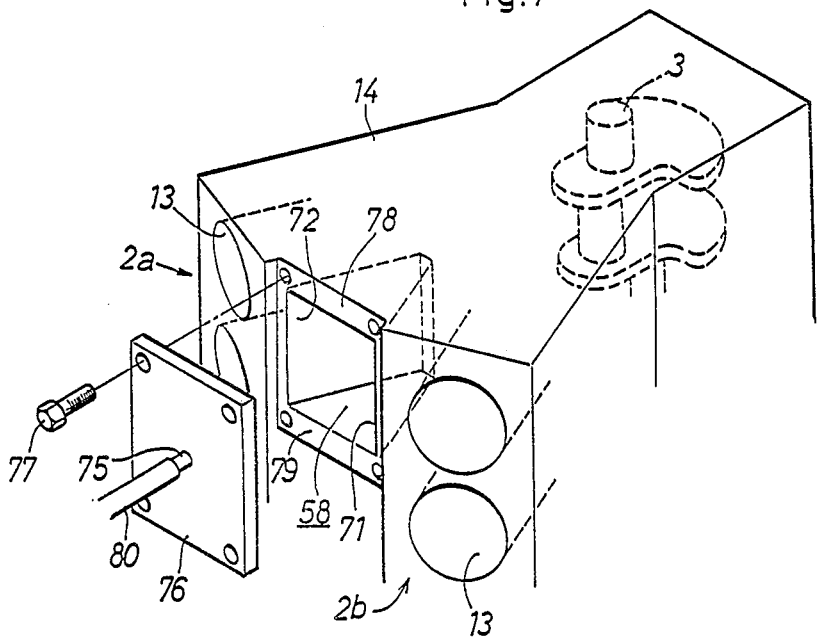
FIG. 7 is a schematic exploded perspective view similar to FIG. 6 showing an alternative embodiment of the breather chamber according to the present invention.

FIG. 7 shows an alternative embodiment of the breather chamber 58. Two ends walls 78 and 79 as well as the opposing surfaces 71 and 72 are formed integrally with the cylinder block 14. According to this embodiment, a bridging wall in the form of a plate 76 having a breather port 75 is fitted over the gap defined by the ends walls 78 and 79 and the opposing surfaces 71 and 72 by means of bolts 77 and defines the enclosed breather chamber 58.

In either embodiment, a hose 80 is connected to the breather port 75 to release the breather gas to an appropriate part of the engine.

Thus, the height and the width of a vertical V-type outboard marine engine are determined by the overall length of the crank shaft and the angle between the two cylinder banks 2*a* and 2*b*, respectively. Thus, according to the above-described embodiment, because the intake system is placed between the two cylinder banks 2*a* and 2*b* while the intake tubes 37 extend from the two cylinder banks toward each other and away from the crank shaft 3 of the engine, even though the angle between the two cylinder banks 2*a* and 2*b* is small, the carburetor unit 4 can be accommodated in the space between the two cylinder banks 2*a* and 2*b* without impairing the intake efficiency.

Also, by providing the exhaust systems on the external faces of the two cylinder banks 2*a* and 2*b* and making the exhaust passages of the exhaust manifolds 35 curve towards the crank shaft 3, the exhaust manifold 35 may be provided without increasing the overall width of the engine beyond the profile defined by the cylinder head covers 16.

Thus, according to the present invention, the angle between the two cylinder banks 2*a* and 2*b* may be made small enough to provide the advantage of a reduced overall width of the V-type engine. Therefore, when this engine is used as an outboard marine engine, considerable space can be saved and this is extremely advantageous when more than one engine is to be mounted on one boat in a parallel relationship.

Although the present invention has been shown and described with reference to the preferred embodiments thereof, it should not be considered as limited thereby. Various possible modifications and alterations could be conceived of by one skilled in the art to any particular embodiment, without departing from the scope of the invention.

What we claim is:

1. A V-type vertical engine having a crank shaft extending vertically and a pair of cylinder banks forming a certain angle therebetween, comprising:

intake ports which are located adjacent to the internal sides of the cylinder banks and communicated with combustion chambers of the engine by way of intake valves;

intake tubes which are connected to the intake ports and, at least in part thereof, extend along a central line between the two cylinder banks away from the crank shaft of the engine;

exhaust ports which are located adjacent to the external sides of the cylinder banks and communicated with the combustion chambers of the engine by way of exhaust valves;

exhaust passages which, at least in part thereof, extend along a cylinder axial line towards the crank case;

a cooling water passage consisting of a central conduit extending in a central plane located between the two cylinder banks in parallel with the crank shaft of the engine; and wherein a thermostat valve is accommodated in a thermostat valve chamber defined by a chamber member which is supported by a pair of transfer conduits extending from upper surfaces of the two cylinder banks, the thermostat valve chamber being communicated with water jackets in the cylinder banks by way of the transfer conduits as well as with the central conduit.

2. A V-type vertical engine as defined in claim 1, further comprising an exhaust manifold which is integrally formed with the cylinder head and provided with a water jacket.

3. A V-type vertical engine having a crank shaft extending vertically and a pair of cylinder banks forming a certain angle therebetween, comprising:

intake ports which are located adjacent to the internal sides of the cylinder banks and communicated with combustion chambers of the engine by way of intake valves;

intake tubes which are connected to the intake ports and, at least in part thereof, extend along a central line between the two cylinder banks away from the crank shaft of the engine;

exhaust ports which are located adjacent to the external sides of the cylinder banks and communicated with the combustion chambers of the engine by way of exhaust valves;

exhaust passages which, at least in part thereof, extend along a cylinder axial line towards the crank case; and a breather chamber communicating with the crank case, said breather chamber defined by a pair of opposing faces of the two cylinder banks, a pair of end walls, at least one of said end walls being integrally formed with the cylinder block; and a bridging wall connecting the opposing faces of the cylinder blocks with each other at ends of said faces remote from the crank shaft, and wherein one of the bridging wall and the other of said end walls is provided as a removable plate.

4. A V-type vertical engine as defined in claim 3 wherein the other of said end walls is provided as the removable plate.

5. A V-type vertical engine as defined in claim 3 wherein the bridging wall is provided as the removable plate.

6. A V-type vertical engine having a crank shaft extending vertically and a pair of cylinder banks forming a certain angle therebetween, comprising:

intake ports which are located adjacent to the internal sides of the cylinder banks and communicated with combustion chambers of the engine by way of intake valves;

intake tubes which are connected to the inake ports and, at least in part thereof, extend along a central line between the two cylinder banks away from the crank shaft of the engine;

exhaust ports which are located adjacent to the external sides of the cylinder banks and communicated with the combustion chambers of the engine by way of exhaust valves;

exhaust passages which, at least in part thereof, extend along a cylinder axial line towards the crank case, wherein said exhaust passages include exhaust manifolds having lateral external ends which are located more inwardly than lateral external ends of cylinder head means attached to said cylinder banks, and wherein said exhaust manifolds are integrally formed with the cylinder head and provided with a water jacket; and a breather chamber communicating with the crank case by way of a one way valve, the breather chamber defined by a pair of opposing faces of the two cylinder banks, a bridging wall integrally formed with the cylinder block of the engine so as to connect the opposing faces of the cylinder banks with each other at their ends remote from the crank shaft, an end wall which is also integrally formed with the cylinder block and closes the bottom end of a space defined by the opposing faces and the bridging wall, and a plate member which is fitted over the open end of the space defined by the opposing faces, the bridging wall and the end wall.

7. A V-type vertical engine having a crank shaft extending vertically and a pair of cylinder banks forming a certain angle therebetween, comprising:

intake ports which are located adjacent to the internal sides of the cylinder banks and communicated with combustion chambers of the engine by way of intake valves;

intake tubes which are connected to the intake ports and, at least in part thereof, extend along a central line between the two cylinder banks away from the crank shaft of the engine;

exhaust ports which are located adjacent to the external sides of the cylinder banks and communicated with the combustion chambers of the engine by way of exhaust valves;

exhaust passages which, at least in part thereof, extend along a cylinder axial line towards the crank case, wherein said exhaust passages include exhaust manifolds having lateral external ends which are located more inwardly than lateral external ends of cylinder head means attached to said cylinder banks, and wherein said exhaust manifolds are integrally formed with the cylinder head and provided with a water jacket; and a breather chamber communicating with the crank case by way of a one way valve, the breather chamber defined by a pair of opposing faces of the two cylinder banks, a pair of end walls which are integrally formed with the cylinder block and close the top end and the bottom end of a space defined by the opposing faces, and a plate member which is fitted over the open end of the space defined by the opposing faces and the end walls.

* * * * *